US006345163B1

(12) United States Patent
Suzuki et al.

(10) Patent No.: US 6,345,163 B1
(45) Date of Patent: Feb. 5, 2002

(54) DEVELOPING DEVICE FOR IMAGE FORMING APPARATUS

(75) Inventors: Katsuhiko Suzuki; Takao Umeda, both of Mito; Hisao Okada, Hitachi, all of (JP)

(73) Assignee: Hitachi Koki Co. Ltd., Tokyo (JP)

( * ) Notice: Subject to any disclaimer, the term of this patent is extended or adjusted under 35 U.S.C. 154(b) by 0 days.

(21) Appl. No.: 09/669,673

(22) Filed: Sep. 26, 2000

(30) Foreign Application Priority Data

Sep. 30, 1999 (JP) ..... 11-277738
Mar. 17, 2000 (JP) ..... 2000-075120

(51) Int. Cl.[7] ..... G03G 15/00
(52) U.S. Cl. ..... 399/61; 399/255
(58) Field of Search ..... 399/254, 255, 399/258, 259, 260, 269, 273, 283, 256, 61, 62, 63, 64

(56) References Cited

U.S. PATENT DOCUMENTS 3,894,514 A * 7/1975 Caudill et al. ..... 399/93
3,911,864 A * 10/1975 Hudson ..... 399/255
3,943,887 A * 3/1976 Smith ..... 399/255
4,056,076 A * 11/1977 Smith ..... 399/256
4,354,763 A * 10/1982 Koiso et al. ..... 399/277
4,937,625 A * 6/1990 Kato et al. ..... 399/258
5,257,076 A * 10/1993 Nishimura et al. ..... 399/27
5,430,530 A * 7/1995 Ott et al. ..... 399/256
5,652,947 A * 7/1997 Izumizaki ..... 399/58
5,710,962 A * 1/1998 Isoda et al. ..... 399/260

FOREIGN PATENT DOCUMENTS

JP 10-177293 * 6/1998

* cited by examiner

*Primary Examiner*—Robert Beatty
(74) *Attorney, Agent, or Firm*—Antonelli, Terry, Stout & Kraus, LLP

(57) ABSTRACT

A developing device for use in an image forming apparatus has control means operatively responsive to receipt of an output signal of a first toner density detector means provided in a development unit for driving developing powder delivery means provided in a preliminary mixture/stirring unit to supply developing powder from a stirring chamber toward the development unit, while controlling regulator means so that introduction of the developing powder to the stirring chamber is inhibited at least within a developing powder refilling time period.

6 Claims, 4 Drawing Sheets

DEVELOPING DEVICE FOR IMAGE FORMING APPARATUS

BACKGROUND OF THE INVENTION

The present invention relates generally to developing devices which are adaptable for use in image forming apparatuses, typically including printers and copying machines.

Currently available image forming apparatuses for the formation of images by use of known electrophotography processes are typically designed to form a toner image on a photosensitive body serving as an image carrier body by a method including the steps of electrostatically charging the photosensitive body up to a specified voltage potential, then performing image exposure to form an electrostatic latent image on the photosensitive body, and supplying developing powder onto a surface of the photosensitive body on which this electrostatic latent image is held to thereby develop the electrostatic latent image. The toner image thus formed on the photosensitive body is transferred to a recording material (paper sheet in most cases) and then outwardly transferred as a printed sheet from the image forming apparatus.

A developing device such as widely used with an image forming apparatus of the type described above is generally designed to include a development unit and a toner tank unit. Here, the development unit is a component which includes a developing powder storage unit for storage of developing powder, a development roller for feed and delivery of the developing powder within said developing powder storage unit toward the photosensitive body, and a toner density sensor for detection of the density of the toner of such developing powder within said developing powder storage unit. In addition, the toner tank unit is a component that includes a toner storage unit for storage of toner, along with toner delivery means for delivery of toner out of said toner storage unit.

In the developing device of the type described above, the toner in the developing powder within the developing powder storage unit is gradually consumed. In cases where the toner density in the developing powder decreases and becomes lower than a preset toner density reference value, the toner density sensor operates to detect this state and then to control the toner delivery means to additionally supply toner within the toner tank unit to the developing powder storage unit.

Unfortunately, the prior art image forming apparatus has a problem in that, in the case of an arrangement for directly supplying toner from the toner tank unit to the development unit in the way discussed above, a supply of toner to the surface of the photosensitive body is unintentionally carried out at a time when the developing powder within the development unit and the toner that has been newly supplied to the development unit are not yet sufficiently stirred to provide a proper mixture, which could result in formation of a toner image with density irregularities and/or production of printed matter with toner contamination at the background of a sheet of paper. This problem will readily take place especially when an attempt is made to speed up the developing device, and thus is one of the most important problems to be solved in the attempt to provide a developing device capable of providing for high-speed operations.

One prior known approach, which has been previously proposed by the present inventors, to solve the above-noted problem is to provide a specific developing device which is arranged to include a mixture/stirring chamber disposed between the toner tank unit and the development unit for mixture of the toner that is delivered out of the toner tank unit with developing powder in the stirring chamber prior to supplying this additional toner to the development unit, to thereby ensure that the development unit is filled only with toner that has a stabilized friction electrification state or the like (for detail see JP-A-10-177293).

SUMMARY OF THE INVENTION

The present invention is directed to an improvement of the developing device as disclosed in JP-A-10-177293, and its primary objective is to achieve a developing device with increased reliability of developing powder and toner feed/transfer control at a toner tank unit and preliminary mixture stirring unit, as well as in the development unit thereof. Another object of the invention is to provide a developing device which is capable of producing stable images even when continuous printing is carried out for an extended length of time.

The foregoing objects may be attained by providing a new and improved developing device for use in an image forming apparatus for supplying developing powder to an image carrier body having an electrostatic latent image on the surface thereof and for forming a toner image on said image carrier body. The developing device comprises a development unit including a developing powder storage unit storing therein developing powder and a developing powder supply means for supplying and delivering developing powder within said developing powder storage unit toward said image carrier body, as well as first toner density detector means for detecting the toner density of the developing powder within said developing powder storage unit. The developing device further includes a toner tank unit including a toner storage unit storing toner therein, and toner delivery means for outwardly delivering toner from said toner storage unit.

The developing device also includes a preliminary mixture/stirring unit including a stirring chamber for mixing the developing powder which is released from said developing powder supply means with the toner delivered from said toner tank unit, developing powder delivery means for delivering the developing powder out of said stirring chamber, second toner density detector means for detecting the toner density of the developing powder within said stirring chamber, developing powder amount detector means for detecting an amount of developing powder within said stirring chamber and regulator means for regulating the delivery of the developing powder that is released from said developing powder supply means into said stirring chamber.

A control means is operatively responsive to receipt of an output signal of said first toner density detector means for driving said developing powder delivery means to supply developing powder from said stirring chamber to said development unit, while controlling said regulator means to inhibit introduction of the developing powder into said stirring chamber at least within a specified time period for supplying said developing powder to said development unit.

In accordance with the present invention, it is possible to provide a developing device for use in an image forming apparatus which has improved reliability in the use of developing powder and in toner feed/transfer control at its toner tank unit and preliminary mixture stirring unit, as well as in the development unit thereof. It is also possible to achieve a developing device for an image forming apparatus which is capable of producing stable images even where continuous printing is carried out for an extended length of time.

DETAILED DESCRIPTION OF PREFERRED EMBODIMENTS

Some preferred embodiments of the present invention will now be set forth in detail with reference to the accompanying drawings.

A developing device incorporating the principles of the present invention, as disclosed and claimed herein, is arranged to generally include three major parts: a development unit, preliminary mixture/stirring unit, and toner tank unit. An explanation will be given of these components on a per-unit basis in conjunction with FIG. 1.

Figure 1:
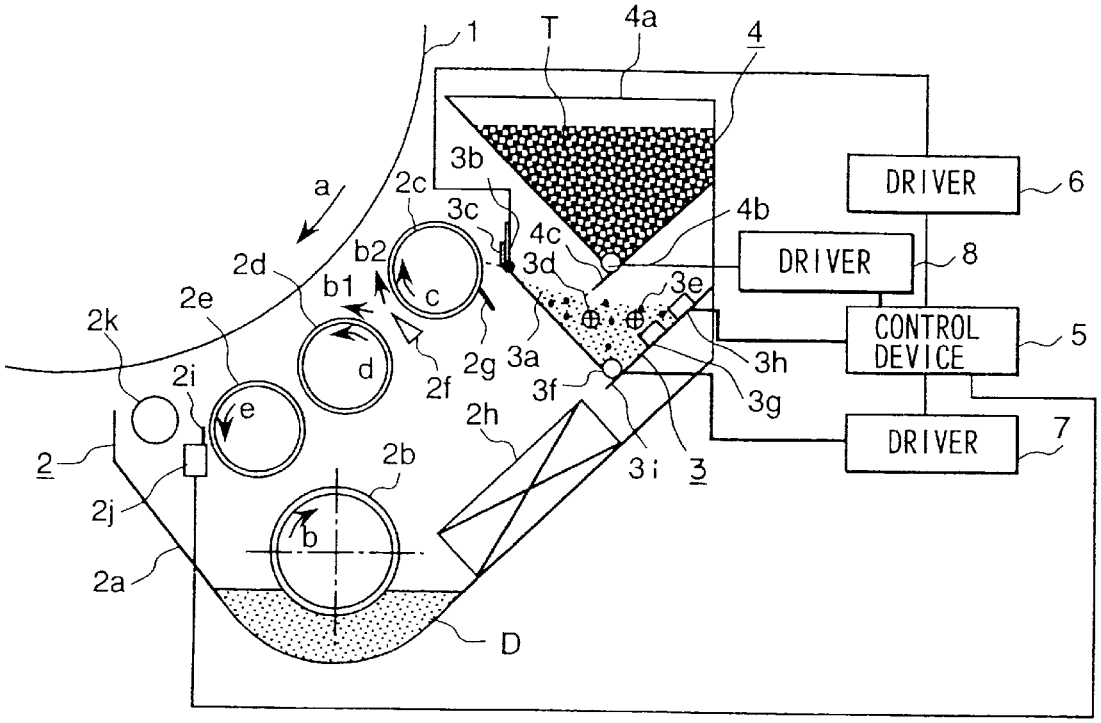
FIG. 1 is a diagram schematically showing an arrangement of one preferred embodiment of the developing device of the present invention.

In FIG. 1, reference numeral "2" designates the entirety of a development unit. The development unit 2 includes a developing powder storage unit 2*a* (referred to as a "development container or vessel" hereinafter), which is designed to contain therein a two-component based or "binary" developing powder D comprising a mixture of toner and carriers, wherein the developing powder D is normally kept in store at the bottom of the development vessel 2*a*. The development vessel 2*a* has at its lower part a conveyer or carrier roller 2*b*, which is supported for conveyance of the developing powder D. The carrier roller 2*b* is typically made up of a non-rotatable magnet roller (not shown) with its magnetic poles of prespecified polarity disposed at a plurality of portions along the circumferential direction, by way of example, and a rotatable sleeve member (not shown) provided at the outer periphery of said magnet roller, wherein conveyance or transfer of developing powder D is carried out by causing said sleeve member to rotate in a direction indicated by the arrow "b" in FIG. 1. Note here that the arrangement of the carrier roller 2*b* should not be limited to the one specifically illustrated, and that the carrier roller 2*b* may be modified so that the intended developing powder transfer is carried out by use of a puddle roller with no magnets or other similar suitable components.

In the development vessel 2*a*, developing rollers 2*c*, 2*d*, 2*e* for use as developing powder supply means are provided at specified portions opposing the surface of a photosensitive body 1 that serves as an image carrier. Note that, although the present invention should not be limited to any specific number of such developing rollers, three developing rollers are illustratively employed in this embodiment for purposes of convenience in discussion of the features of the apparatus.

The developing rollers 2*c*–2*e* are each structured in a manner similar to the carrier roller 2*b* so that each roller is formed, for example, of a nonrotatable magnet roller (not shown) with its magnetic poles of prespecified polarity disposed at a plurality of portions along the circumferential direction, by way of example, and a rotatable sleeve member (not shown) provided at the outer periphery of said magnet roller. A specific one of such three developing rollers, which is provided on the upstream side in the photosensitive material move/travel direction, i.e. the developing roller 2*c*, is designed to rotate in the direction of the arrow "c" (clockwise rotation direction), while the remaining developing rollers 2*d*–2*e* are provided to rotate in the direction of the arrows "d" and "c", respectively (each in the counter-clockwise direction).

It should be noted in FIG. 1 that a developer distribution member 2*f* is provided between the developing roller 2*c* and developing roller 2*d*; a scraper 2*g* is provided for use in removing any residual developing powder held on the developing roller 2*c*; and a mixture stirring instrument 2*h* is provided for applying a stirring or mixing action to the developing powder falling down from the scraper 2*g*.

In addition, with regard to those members provided in close proximity to the developing roller 2*e*, a scraper 2*i* is provided for use in removing any residual developing powder held on the developing roller 2*e*, and a toner density sensor 2*j* (formed for example of a magnetic permeability sensor) is provided for use as a first toner density detector means for detection of the density of toner introduced thereinto while being guided by the scraper 2*i*. Furthermore, a carrier catch roller 2*k* is provided for removal of carrier particles which have become attached to the surface of the photosensitive body 1 at the development process steps.

In the arrangement described above, developing powder D that has been transferred by the carrier roller 2*b* is first passed to the back surface of the developing roller 2*e*, that is, on the side which does not oppose the surface of the photosensitive body 1. Then, the developing powder is conveyed and carried by the developing roller 2*e* to the back face of the developing roller 2*d*, which is disposed over the developing roller 2*e*, and is next transferred to the area of the distribution member 2*f*.

The developing powder that has been conveyed to the distribution member 2*f* is guided so as to pass through the area between the developing roller 2*d* and the distribution member 2*f* and is then diverted for distribution into a first developer layer, which is transferred in a direction indicated by the arrow b1, and a second developer layer, which, after progression around the backside of the distribution member 2*f* so as to flow between the developing roller 2*c* and distribution member 2*f*, is transferred in a direction shown by the arrow b2.

A certain part of such distributed developer components which forms the first developer layer is sent forth by the developing roller 2*d* and developing roller 2*e* into contact with the surface of the photosensitive body 1 to effect development of an electrostatic latent image on the photosensitive body 1. Additionally, any developer that has passed through the development region at the developing roller 2*e* is removed by the scraper 2*i* from the developing roller 2*e* and is returned to the bottom section of the development vessel 2*a* by way of the toner density sensor 2*j*.

On the other hand, the remaining developer component forming the second developer layer is transferred by the developing roller 2*c* into contact with the surface of the photosensitive body 1 to effect development of the electrostatic latent image on the photosensitive body 1. Note that any developer that has passed through the development region at the developing roller 2*c* is removed away by the scraper 2*g* from the developing roller 2*c* so as to drop down and return to the bottom section of the development vessel 2*a* through the mixture stirrer 2*h*.

So far, the arrangement of the development unit constituting part of the developing device in accordance with the present invention has been explained. Additionally, the toner density sensor 2*j* is designed so that its output signal is input to a control device 5, as shown in FIG. 1, to provide control in a way that will be set forth in greater detail later in description.

An explanation will next be given of the arrangement of the preliminary mixture stirring unit.

The reference numeral 3 is used in FIG. 1 to designate the entirety of the preliminary mixture stirring unit. The preliminary mixture stirring unit 3 is disposed between the development unit 2 and a toner tank unit 4, which is to be later described. The preliminary mixture stirring unit 3 includes a stirring chamber 3*a*, at an upper part of which an inlet port 3*b* is provided for accepting and taking thereinto developer that has been transferred by the developing roller 2*c*. The inlet port 3*b* is designed so that it is blocked by an open-close member 3*c*, operating as a valve and serving as a regulator means in the event that transfer of developer into the stirring chamber 3*a* is not required. The open-close member 3*c* is arranged such that its distal end comes into contact with the developing roller 2*c*, as indicated by a broken line in FIG. 1, when the inlet port 3*b* is opened, thereby permitting the open-close member 3*c* itself, to function as a scraper.

In addition, the stirring chamber 3*a* is operatively associated with stirring members 3*d*, 3*e* that are rotatably supported therein for stirring the developer received from the developing roller 2*c* and mixing it with the toner that is delivered from the toner tank unit 4, as will be later described. The stirring chamber 3*a* has a bottom section at which a developer feed roller 3*f* is rotatably and drivably provided for use as a developer delivery means for outward delivery of developer toward the development unit 2.

Additionally, as seen in FIG. 1, a toner density sensor 3*g* (formed for example of a magnetic permeability sensor), constituting a second toner density detector means, is provided for detecting the density of toner in the developer residing within the stirring chamber 3*a*. Also, a developer level sensor 3*h* (formed for example of a magnetic bridge density sensor or alternatively of a vibration sensor or the like) is provided for use as a developer amount detector means for detection of the amount of developer residing within the stirring chamber 3*a*. Finally, a plate member 3*i* is disposed so that it is capable of coming into contact with an outer peripheral surface of the developer feed roller 3f.

So far, the arrangement of the preliminary mixture stirring unit constituting part of the developing device in accordance with the present invention has been discussed. Note that the toner density sensor 3*g* and developer level sensor 3*h* are designed so that their outputs are input to the control device 5, as shown in FIG. 1, to provide control in a way that will be set forth in more detail later in this description. Also, note that the open-close member 3*c* and developer feed roller 3*f* are operatively connected to the controller 5 via driver devices 6, 7, respectively.

An explanation will next be given of the arrangement of the toner tank unit.

Numeral 4 is used in FIG. 1 to indicate the entirety of the toner tank unit. The toner tank unit 4 includes a toner storage unit 4*a* (referred to hereafter as a "toner vessel") which contains therein only toner T to be later mixed with the developer being used. The toner vessel 4*a* has a bottom section at which a toner feed roller 4*b* is rotatably and drivably supported for use as a toner delivery means for outward delivery of the toner T. The toner feed roller 4*b* is connected via a driver 8 to the controller 5, which will be described in more detail later in this description. Note that a plate member 4*c* is disposed so that it is capable of coming into contact with the outer peripheral surface of the toner feed roller 4*b*.

A series of operations which occur during printing will next be explained. It will readily occur to those skilled in the art that prior to start-up of printing, binary powdery developer D, containing therein toner and carrier particles, is received within the development unit 2. It will also be appreciated that a predefined amount of developer is received in advance within the stirring chamber 3*a*, while the toner vessel 4*a* contains only toner T.

Upon issuance of a print start signal, the photosensitive body 1 begins to move in the direction indicated by the arrow "a", while, at the same time, the carrier roller 2*b* and carrier catch roller 2*k* begin rotating. In addition, at the preliminary mixture stirring unit 3, the stirring members 3*d*, 3*e* rotate for a fixed length of time, causing the developer residing within the stirring chamber 3*a* to undergo frictional electrification at a constant value.

While printing is being carried out continuously, the toner in the developer within the development unit 2 is gradually consumed causing the amount of toner within the developer to decrease so that the toner is reduced in density accordingly. When the toner density sensor 2*j*, as provided in the development unit 2, detects that the toner density has been lowered to a predetermined level, a toner refill signal is generated and issued to the controller 5.

Upon receipt of the toner refill signal, the controller 5 initiates operation of the driver 7 for driving the developer feed roller 3*f* in the preliminary mixture stirring unit 3, thereby allowing the developer feed roller 3*f* to rotate for a preset length of time or to a preset position to supplement the supply of developer in the development unit 2. This developer that has been supplied from the preliminary mixture stirring unit 3 to the development unit 2, along with developer that has been released from the developing roller 2*c* by the scraper 2*g* for delivery to the mixture stirrer 2*h*, is sent to the bottom section of the development vessel 2*a* after completion of mixture stirring at the mixture stirrer 2*h*.

Upon interruption or termination of delivery of developer out of the developer feed roller 3*f*, the controller 5 next renders the driver 6 of open-close member 3*c* operative so that the open-close member 3*c* opens for a specified length of time. During this time, the developer that is released from the developing roller 2*c* is introduced into the stirring chamber 3*a* to thereby perform refilling of an appropriate amount of developer which is "depleted" due to the supply of developer to the development unit 2.

The amount of developer being delivered into the stirring chamber 3*a* is monitored by the developer level sensor 3*h* on a real-time basis in such a way that, whenever the resultant developer reaches the level of the developer level sensor 3*h*, the developer level sensor 3*h* generates and issues an electrical signal indicative of the fact that the developer in the stirring chamber 3*a* has reached a predefined amount, which signal is then sent to the controller 5. Upon receiving this signal, the controller 5 forces the driver 6 to set the openclose member 3*c* to its closed state.

In the way described above, the developer that has been delivered into the stirring chamber 3*a* is stirred by the stirring members 3*d*, 3*e* while simultaneously causing the toner density sensor 3*g* to detect the present toner density. Here, in the event that a toner refill signal is sent from the toner density sensor 3*g* to controller 5, the controller 5 initiates operation of the driver 8 of toner feed roller 4*b* to supply the toner T within the toner vessel 4*a* to the stirring chamber 3*a*.

Repeated execution of the above-stated operations during printing ensures that developer which is stable in both toner density and in its rectification state will be supplied to the development unit 2, which in turn makes it possible to obtain printed matter of good quality without suffering from any density irregularities and toner contaminations even where delivery of developer is carried out by the carrier roller 2*b* toward the developing rollers 2*c*–2*e* immediately after the supplement of the developer in the development unit 2.

An explanation will next be given of details of the developing device in conjunction with the layout of respective parts or members and the shapes thereof, and the like.

A magnetic permeability sensor for measurement of the bulk density of developer may be employed as the toner density sensor 3*g* that is provided within the stirring chamber 3*a*. In addition, the toner density sensor 3*g* is specifically located beneath the stirring member 3*e* to thereby guarantee that the developer being used is successfully guided to pass over the toner density sensor 3*g* with increased efficiency, to thereby enable detection of any intended toner densities with enhanced stability. Additionally, since the toner density sensor 3*g* also is disposed adjacent to the developer feed roller 3*f*, it becomes possible to obtain the advantage of accurate detectability of the toner density of the developer being supplied to the development unit 2.

Figure 2:
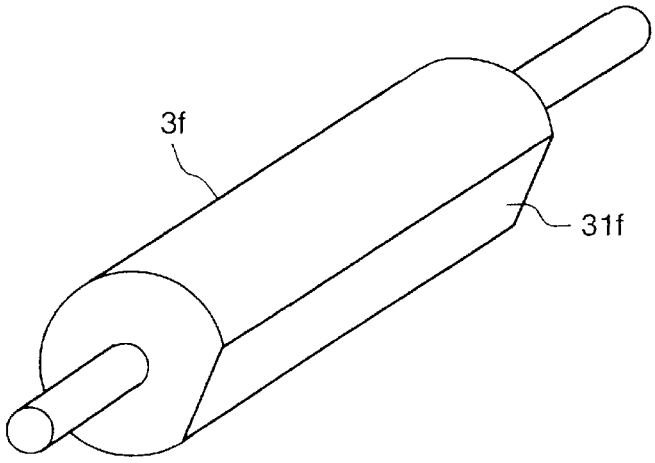
FIG. 2 is a perspective view of a developing powder feed roller.

As shown in FIG. 2, the developer feed roller 3*f* is designed into a generally columnar or cylindrical rod-like shape, with a flat face portion 31*f* partly formed therein. Note here that although the illustrative example is arranged so that a single flat face portion 31*f* is provided, this may be modified so that a plurality of flat faces may also be provided at multiple portions thereof.

Figure 3:
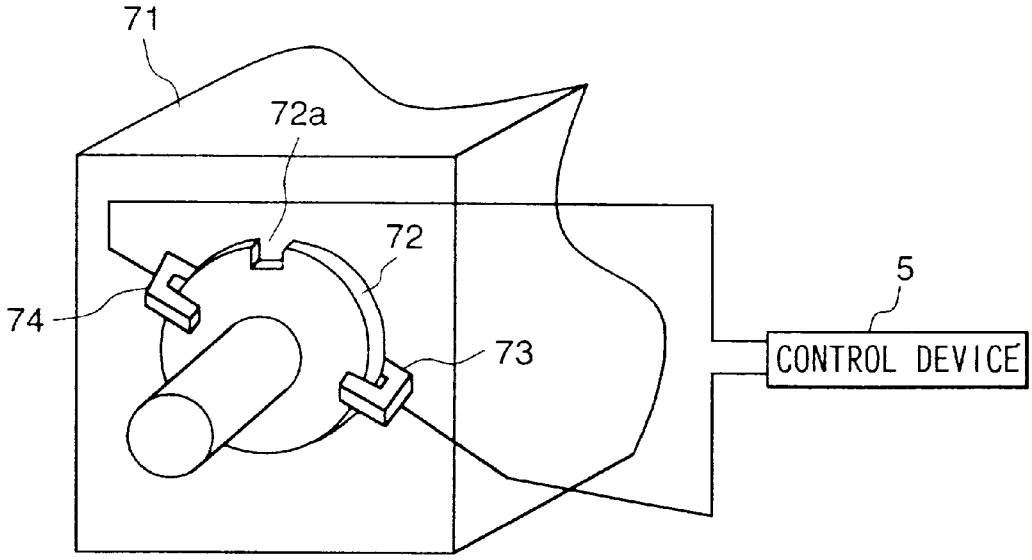
FIG. 3 is a diagram showing enlarged partial view of main part of a driver device of the developing powder feed roller.

Referring to FIG. 3, there is shown an enlarged partial perspective view of a driver device associated with the developer feed roller 3*f*, illustrating its detailed arrangement. This driver includes a motor 71 that is rendered operative to drive the developer feed roller 3*f*, in response to the generation of a signal by the toner density sensor 2*j* of the development unit 2, whereby the developer feed roller 3*f* begins to rotate. The motor 71 has a motor shaft which is provided with a round disk-like plate 72 having a cutaway portion 72*a* partly formed therein. When the motor 71 is operated, the disk plate 72 begins rotating from a position where the cutaway portion 72 is at an optical sensor 73. When the disk plate 72 has rotated so that another sensor 74 detects the cutaway portion 72*a* of disk plate 72, the optical sensor 74 will generate a corresponding detection signal, whereby the control device will stop the motor 71 with the disk plate 72 at the position where the cutaway portion is at the sensor 74. Whereby, the motor shaft operatively connected to the disk plate 72 is forced to stop, thus causing the developer feed roller 3*f* to stop.

Figure 4A:
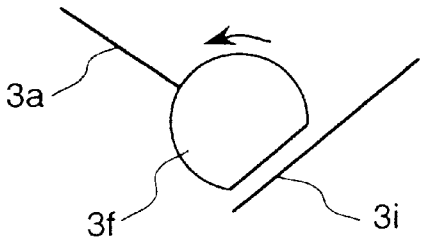
FIGS. 4A and 4B are diagrams respectively showing two major steps in the outward delivery of developing powder using the developing powder feed roller.
Figure 4B:
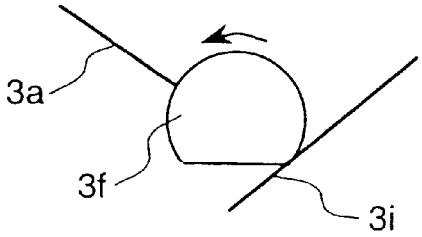

FIGS. 4A and 4B are diagrams each schematically showing a peripheral arrangement of the developer feed roller 3*f*. In FIGS. 4A and 4B, 3*a* indicates a wall surface of the stirring chamber, and 3*i* denotes a plate member. When the developer feed roller 3*f* stops its rotation with the cutaway portion 72 at the position of the aforesaid sensor 74, the flat face portion 31*f* that is formed in the developer feed roller 3*f* is in a state where it is parallel to the plate member 3*i*, as shown in FIG. 4A, thus enabling supply of developer from the stirring chamber 3*a* to the development unit 2 through the resultant gap formed thereby.

By having the controller 5 control the stop time of the feed roller 3*f* with the cutaway portion 72 located at the sensor 74 makes it possible to accurately control the supply of an exact amount of developer to the development unit 2. After the feed roller 3*f* has been stopped with the cutaway portion 72 the position of sensor 74 for a predefined length of time, the developer feed roller 3*f* is driven again to return the cutaway portion 72 to the position of sensor 73, so that the flat face portion 31*f* of the developer feed roller 3*f* is no longer in a parallel state relative to the plate member 3*i*, as shown in FIG. 4B, thereby preventing outward delivery of developer from the stirring chamber 3*a*.

Figure 5:
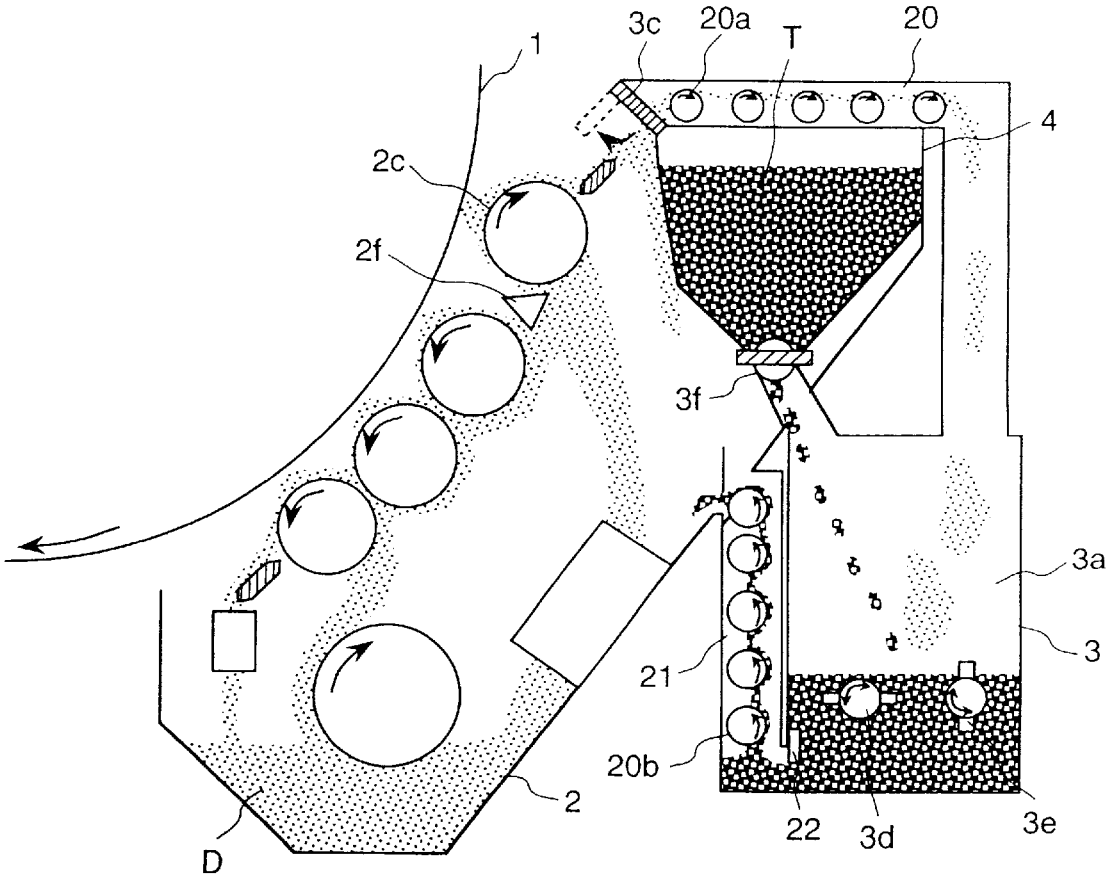
FIG. 5 is a diagram schematically showing another embodiment of the present invention.

FIG. 5 illustrates in cross-section a developing device in accordance with another embodiment of the instant invention. As shown in FIG. 5, additional installation of one more developing roller can result in a decrease in the space within the development vessel 2*a*. Accordingly, if this is the case, it is often preferable for the preliminary mixture stirring unit 3 to be disposed outside of the development unit 2.

With this embodiment also, toner T, which is supplied from toner tank unit 4 to stirring chamber 3*a*, is mixed through stirring with developer released from the developing roller 2*c* in the stirring chamber 3*a*.

The stirring chamber 3*a* and development vessel 2*a* are operatively coupled together via a developer inlet path 20 and developer outlet path 21. The developer inlet path 20 is provided with a magnet roller 20*a* for use in transferring developer that has been fed from the developing roller 2*c* to the stirring chamber 3*a*; whereas, the developer outlet path 21 is provided with a magnet roller 20*b* for transferring developer that has been supplied from the stirring chamber 3*a* to be conveyed for delivery toward the development unit 2.

Additionally numeral 22 designates an open-close member that is provided so as to be movable upwardly and downwardly in order to regulate the passage of developer out of the stirring chamber 3*a*.

Figure 6:
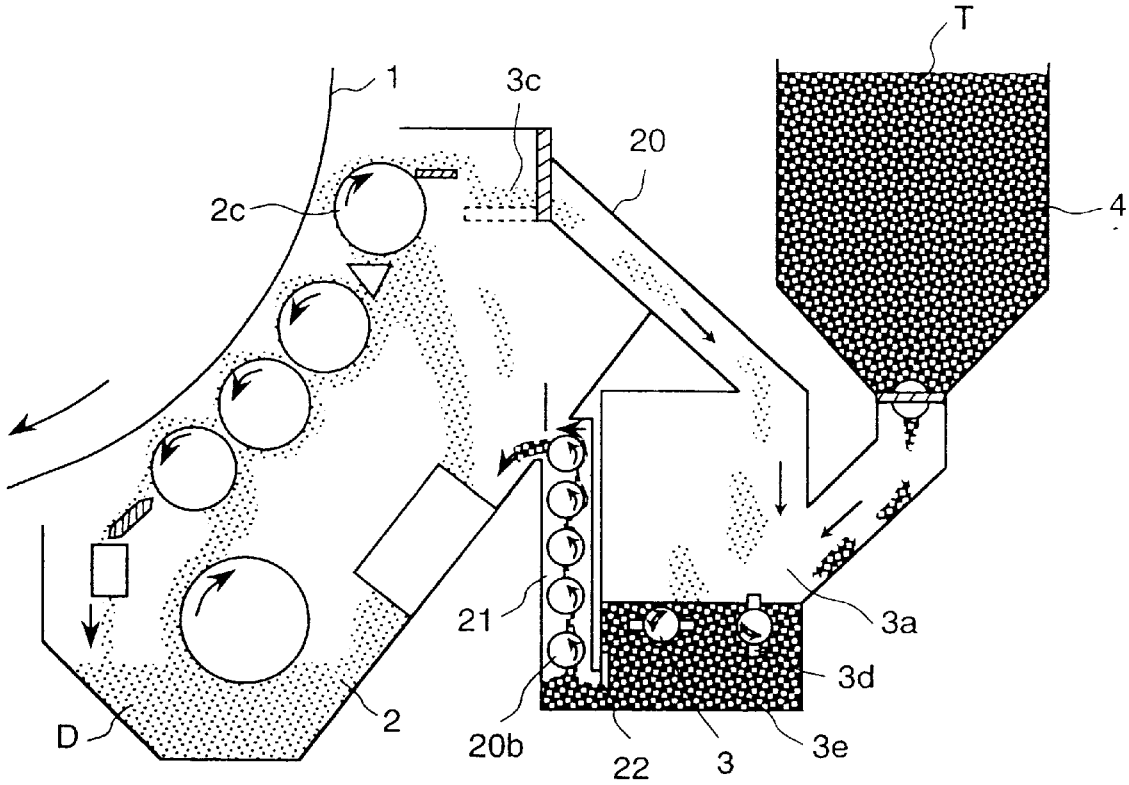
FIG. 6 is a diagram schematically showing still another embodiment of the present invention.

A developing device in accordance with a further embodiment of the invention is shown in FIG. 6, which embodiment is structurally different from that of FIG. 5 in that the toner tank unit 4, in addition to the preliminary mixture stirring unit 3, is disposed outside of the development unit 2. In order to meet the demand for miniaturization or "downsizing" of the development unit 2, while at the same time accommodating large printing capabilities, it is required that the toner vessel 4*a* be capable of storing therein an increased amount of toner, which must result in a corresponding increase in the size of the toner tank unit 4. In view of this, the toner tank unit 4 is placed over the preliminary mixture stirring unit 3, which is provided separately from the development unit 2, as shown in FIG. 6.

In this example, the developer inlet path 20 is structured to have a gradient which permits gravity drop-down of the developer being used. The resultant developer that is preliminarily stirred in the stirring chamber 3*a* is guided and introduced into the developer outlet path 21 and is then delivered by magnet roller 20*b* toward the development unit 2 in a way similar to that of the structure of FIG. 5.

As described above, in accordance with the present invention, it is possible to provide a developing device for use in an image forming apparatus having an improved reliability in the use of developing powder and in toner feed/transfer control at its toner tank unit and preliminary mixture stirring unit, as well as the development unit thereof. It is also possible to achieve a developing device for an image forming apparatus which is capable of obtaining stable images even where continuous printing is carried out for an extended length of time period.

What is claimed is:

1. A developing device of an image forming apparatus for supplying developing powder to an image carrier body having thereon an electrostatic latent image and for forming a toner image on said image carrier body, comprising:

a development unit including a developing powder storage unit storing therein developing powder, developing powder supply means for supplying and delivering the developing powder within said developing powder storage unit toward said image carrier body, and first toner density detector means for detecting toner density of the developing powder within said developing powder storage unit;

a toner tank unit including a toner storage unit storing therein toner and toner delivery means for outwardly delivering toner from said toner storage unit;

a preliminary mixture/stirring unit including a stirring chamber for effecting mixture of the developing powder that is released from said developing powder supply means with the toner delivered from said toner tank unit, developing powder delivery means for delivering the developing powder out of said stirring chamber, second toner density detector means for detecting toner density of the developing powder within said stirring chamber, developing powder amount detector means for detecting an amount of developing powder within said stirring chamber, and regulator means for regulating allowance and inhibition of delivery of the developing powder released from said developing powder supply means toward said stirring chamber; and control means operatively responsive to receipt of an output signal of said first toner density detector means for driving said developing powder delivery means to supply the developing powder from said stirring chamber to said development unit, while controlling said regulator means to inhibit introduction of the developing powder into said stirring chamber at least within a specified time period for refilling of said development unit with developing powder.

2. The developing device of an image forming apparatus as defined in claim 1, characterized in that said control means is operable to control at least one of a drive position and a drive time of said developing powder delivery means.

3. The developing device of an image forming apparatus as defined in claim 1, characterized in that said developing powder delivery means has a drive shaft provided with position detector means for detecting a position of said drive shaft to thereby control rotary motion of said developing powder delivery means by supplying an output signal of said position detector means to said control means.

4. The developing device of an image forming apparatus as defined in claim 1, characterized in that said control means comprises a timer for use in causing said developing powder delivery means to retain a rotary motion state for a predetermined length of time.

5. The developing device of an image forming apparatus as defined in claim 1, characterized in that said regulator means is controlled in response to an output of said developing powder amount detector means.

6. The developing device of an image forming apparatus as defined in claim 1, characterized in that said developing powder amount detector means is a magnetic bridged density sensor.

* * * * *